US005687871A

United States Patent [19]

Pettesch

[11] Patent Number: 5,687,871

[45] Date of Patent: Nov. 18, 1997

[54] SPILL CONTAINER FOR ABOVE GROUND STORAGE TANKS

[75] Inventor: Martin C. Pettesch, Crawford, N.J.

[73] Assignee: Universal Valve Co., Inc., Elizabeth, N.J.

[21] Appl. No.: 632,901

[22] Filed: Apr. 16, 1996

[51] Int. Cl.[6] ..... B65D 51/00

[52] U.S. Cl. ..... 220/565; 220/4.12

[58] Field of Search ..... 220/502, 565, 220/4.12, 476, 484

[56] References Cited

U.S. PATENT DOCUMENTS

| | | | |
|---|---|---|---|
| 262,127 | 8/1882 | Rudy et al. | 220/502 X |
| 1,111,587 | 9/1914 | Iversen | 220/476 X |
| 3,504,787 | 4/1970 | Brockway | 220/476 X |
| 4,807,675 | 2/1989 | Sharp | 220/315 X |
| 4,842,163 | 6/1989 | Bravo | 222/40 |
| 5,301,722 | 4/1994 | Todd et al. | 220/571 X |
| 5,307,389 | 4/1994 | Meneely et al. | 220/4.12 X |
| 5,381,923 | 1/1995 | O'Dea | 220/4.12 X |

*Primary Examiner*—Steven M. Pollard
*Attorney, Agent, or Firm*—Edward Dreyfus, Esq.

[57] ABSTRACT

A remote spill containment apparatus that includes a horizontally oriented cylindrical housing, preferably formed of a single piece of rolled sheet steel closed front and back by welded spun plates. The upper, forward cylinder quadrant is cut away to form the access opening which is closed by an L-shaped lid hinged to rotate for storage beneath the housing to permit safe access to the housing interior. A single, infinitely adjustable post supports the rear of the housing for free access to the spill drain valve assembly located at the cylinder bottom. The round parts prevent snow and rain accumulation above the access opening and reduce manufacturing costs, weight and space of the unit. Spill liquid within the housing flows toward the bottom centerline lowest zone for selective removal through the spill valve assembly.

20 Claims, 3 Drawing Sheets

SPILL CONTAINER FOR ABOVE GROUND STORAGE TANKS

FIELD OF INVENTION

The present invention relates to spill containment apparatus and more particularly to remote or horizontal spill containers for use in filling above ground fuel or oil storage tanks and the like.

BACKGROUND

At one time it was standard practice to fill above ground fuel or oil tanks by connecting the delivery truck hose to a coupling located at the top of the tank to be filled. This required the operator to climb to or mount the tank top increasing the time and personal danger in filling above ground tanks.

As a result, the practice of installing remote coupling at ground level with permanent hose or tubes extending from the ground coupler to the storage tank top zone is in common use today. Now the truck operator simply connects the liquid delivery hose to the ground level horizontal coupler in order to fill above ground tanks. It is also conventional to locate the tank coupler within a spill containment housing to trap contaminating liquids spilling from the coupler or delivery hose.

A typical conventional remote spill containment housing 50 is shown in FIGS. 3 and 4. Housing 50 includes all steel or aluminum box 1 flat plate construction with a back wall 52, bottom wall 54, top wall 56, two side walls 58 and front wall 60. Wall 60 includes a top section 62 angled upward and rearward to top wall 56 and defining an opening 64 to allow access to the housing interior. An upstanding lip 66 completely surrounds opening 64 to prevent rain water or other liquids from entering the housing interior. Lid 68 with handle 70 is hinged to top wall 56 to close on to lip 66 or swing upward on to wall 56 to allow access to the housing. Angle iron 67 mounts on the inside of lid 68 to overlap lip 66 upon closure. A horizontal fill pipe 72 mounts through an opening in wall 52 and extends into the housing interior. Suitable seals assist mounting pipe 72 and prevent entrance or exit of liquids. These seals could include a flexible bellow-like tube 74 or flexible rubber tube. Fill pipe 72 terminates in a fill hose coupling 74 for releasable coupling to a delivery truck hose (not shown). Fill pipe 72 extends to the fill valve (not shown) for the above ground tank (not shown) in the standard manner.

Spill valve 76 mounts to wall 54 in communication with the housing interior and functions to bleed liquid spills inside the housing.

Housing 50 is supported by four legs 78 welded to the corners of wall 54. Legs 78 are height adjustable by means of having two telescoping sections each provided with alignment openings 80. Legs 78 can be adjusted to two or three height positions and secured by bolts 82. Brackets 84 are welded to the feet of legs 78 to increase the footing and provide greater stability for the weight of housing 50.

The conventional containment apparatus experience various technical problems. For example, because of the flat plate design, spill liquid within housing 50 does not fully drain from the housing. Instead oil or fuel tends to remain in the corners or other zones leading to a dirty, grimy, smelly environment. Also because of the box construction with four supporting legs, the space beneath housing 50 is confined restricting the operator's inserting and withdrawing containers needed to catch the drainage from valve 76. Containers located partially under and partially in front of legs 78 become an obstruction which the operator must avoid during use of the apparatus.

In addition, the top hinged lid 68 can cause safety problems for an operator trying to hold up with one hand the weight of the metal lid 68 while reaching with the other hand into the housing for some purpose, such as making or disconnecting the track hose and coupling 74.

Conventional housing 50 is height adjustable to only 2 or three positions which may not be sufficient for all installations. Installers must then use a platform or further support for precise height adjustment.

Further, the box construction is not space efficient, results in excess weight and requires a large number of welds and welded seams during manufacture, which raises the manufacturing cost, time, and materials.

It is an object of the present invention to provide a spill containment apparatus that solves the foregoing technical problems and provides various other advantages over prior containment devices.

SUMMARY OF EXEMPLARY EMBODIMENT OF THE INVENTION

A remote spill containment apparatus according to the principles of the present invention comprises a cylindrical housing preferably formed of rolled sheet steel with its axis horizontally arranged so that spill liquid flows to the bottom center of the housing for substantially complete removal through the spill valve. The top forward section is cut away for easy access to the housing interior. The lid overhangs the horizontal edges of the opening and is hinged to the forward housing lip and opens downward for operator safety and convenience. When closed, a rolled angle piece on the lid overlapping the housing opening edges provides protection from rain water and snow, and the cylindrical design provides natural rounded surfaces for rain and snow run-off above the housing opening. When opened, the lid swings to a stored position beneath the housing.

Another aspect of the apparatus according to the present invention is to mount the housing on a single vertical post preferably cylindrical and welded to the bottom, rear of the housing. This enables the spill liquid drain valve to be located toward the rear of the housing and free access to the spill liquid drain valve for operators, containers or hose connections. In addition, the support post includes a telescoping footer section that permits infinite and precise height adjustment for the housing and a wide area base plate for overall stability.

Other and further objects, advantages, and benefits provided by the apparatus according to the present invention will become apparent with the following detailed description when taken in view of the appended drawings, in which.

DETAILED DESCRIPTION OF PREFERRED EMBODIMENT

Figure 1:
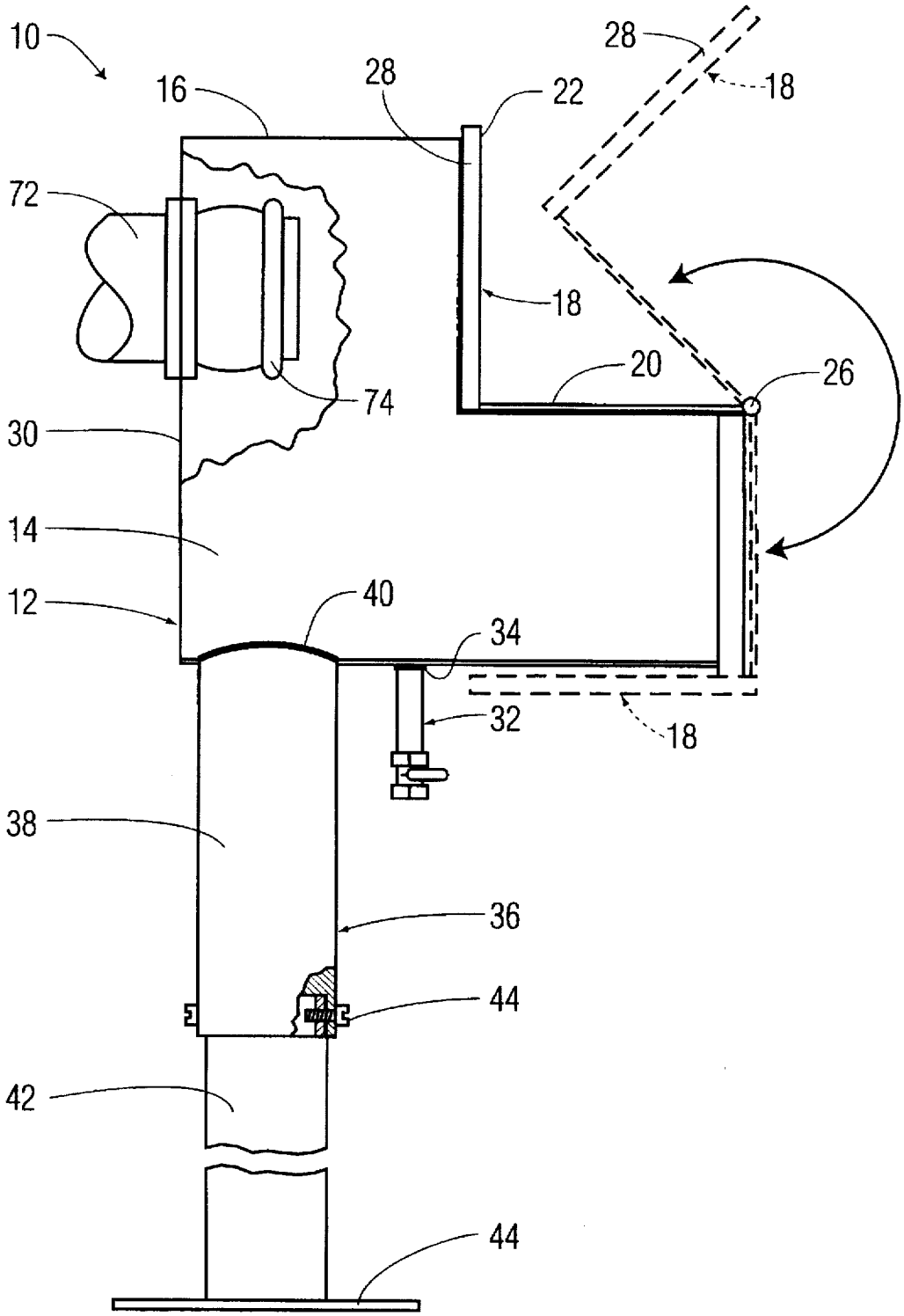
FIG. 1 is a cut-a-way side view of one exemplary embodiment according to the principles of the present invention.
Figure 2:
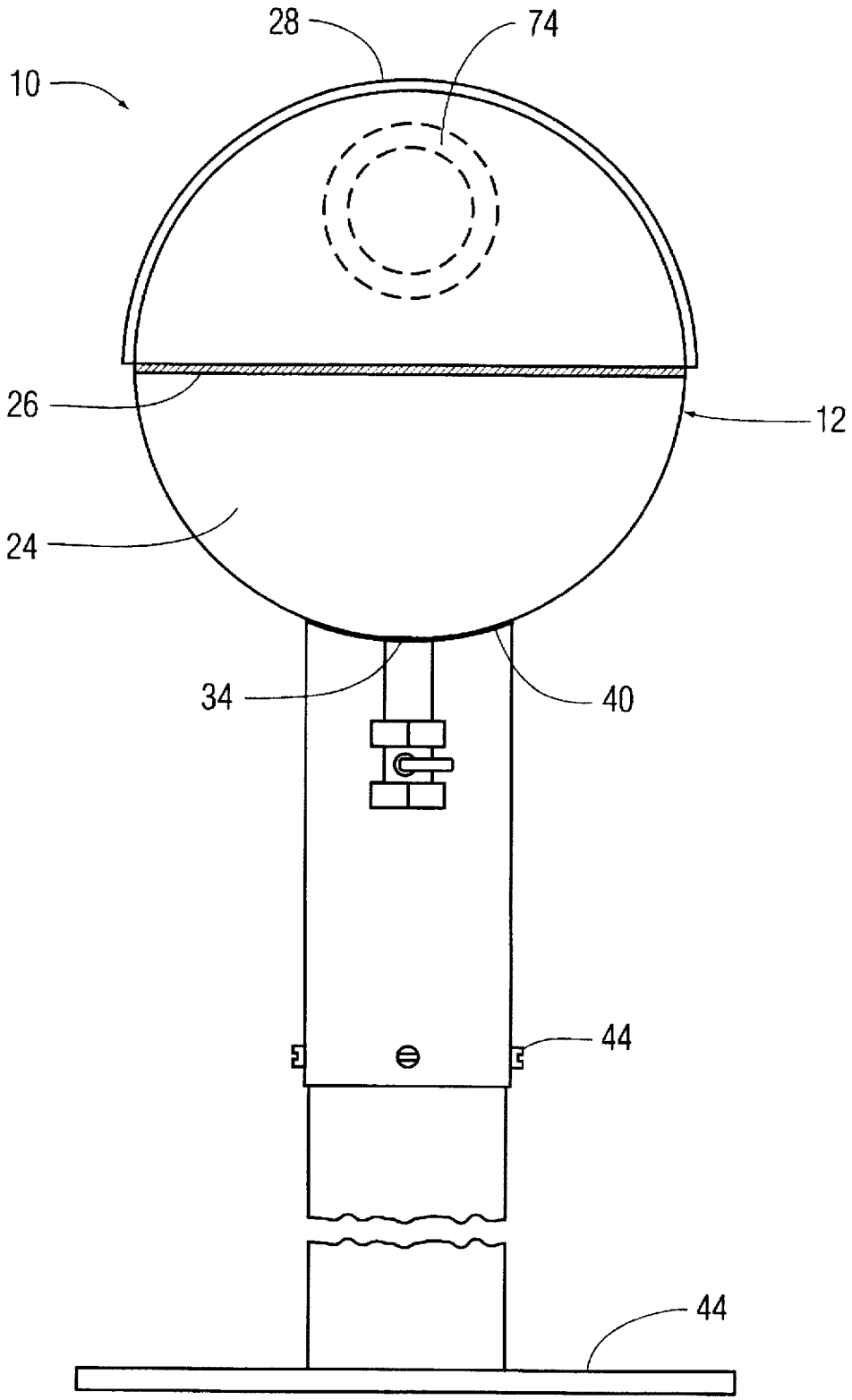
FIG. 2 is a font view of the embodiment of FIG. 1 with the lid fully closed.
Figure 4:
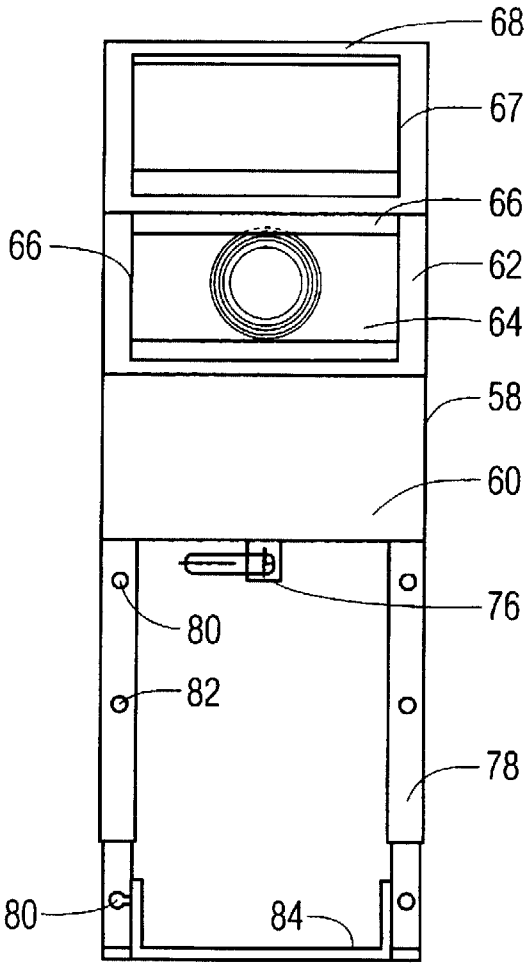
FIG. 4 PRIOR ART
FIG. 4 is a front view of the container of FIG. 3.
Figure 3:
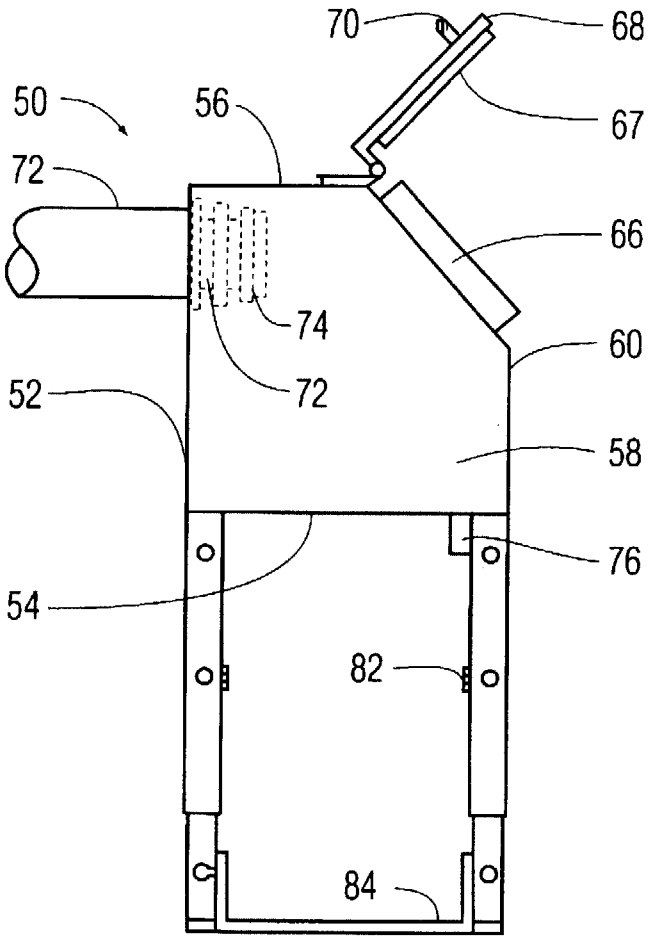
FIG. 3 PRIOR ART
FIG. 3 is a side view of a prior art remote spill container.

Referring to FIGS. 1 and 2, a remote spill containment apparatus 10 according to the principles of the present invention comprises cylindrical housing 12 having a unitary top, side and bottom wall 14 with the cylindrical axis arranged generally horizontally. Wall 14 preferably comprises rolled sheet steel having a single welded seam 16 at the top to form the cylinder.

The forward, upper quadrant of the cylinder is cut away to form an enlarged housing access opening. L-shaped closure member or lid 18 includes plates 20 and 22 welded to each other or bent from a single sheet generally as shown. The forward edge of plate 20 is hinged for rotation to the forward plate 24 by piano hinge 26. Plate 22 is shaped to match the profile of the opening of wall 14 in the vertical plane and plate 20 is shaped to overlap the profile of the opening of wall 14 in the horizontal plane, such as indicated at 19 in FIG. 2. Angle piece 28 extends rearward from the periphery of plate 22 except for the bottom edge thereof so that piece 28, when lid 18 is closed, overlaps the edges of wall 14 that forms the upstanding boundary of the access opening.

Housing 12 is closed by circular, spun end cap 30 that includes an overlapping lip 31 the continuous edge of which is preferably welded to wall 14. Conventional delivery pipe and coupling 74 are mounted through wall 30 in the conventional manner such as with a rubber seal ring 31 and internal sleeve 33. Forward end cap is also preferably a spun circular steel plate 24 with lip 25 that overlaps and is welded to the forward end of wall 14. As seen below, plate 24 is cut to fit the semicircular shape of the housing front profile.

A spill liquid drain pipe and manually operated valve assembly 32 is welded in circular seam 34 at the bottom of continuous wall 14, generally as shown, and wall 14 includes an opening permitting the assembly 32 to communicate with the interior of housing 12. Because of the shape of housing 12 all spill liquid flows to the bottom line of wall 14 for removal through assembly 32.

Housing 12 is supported above ground level by a single post 36 assembly that can be adjusted in an infinite number of height positions. Assembly 36 includes an upper steel post 38, preferably cylindrically shaped, welded at 40 beneath the rear portion of wall 14. A telescoping standard 42, welded to a wide area base plate 44, inserts into the bottom of post 36. During installation, plate 44 is secured as a footing for apparatus 10, post 36 inserts onto standard 42 and housing 12 is raised or lowered to a desired position. Holes are then drilled in the overlapping parts of standard 42 and post 38 which are then secured preferably by fasteners 44 or, alternatively, by welding the post and standard together.

During operation, when in the stored, unused condition, lid 18 is in the closed position shown in solid lines of FIG. 1. When an operator desires to connect a truck delivery hose, the operator swings lid 18 dock-wise in FIG. 1 to the position where plate 22 lies below the forward part of wall 14. With lid 18 stored conveniently and entirely below the access opening, there is no chance that lid 18 can close while the operator's hand is within housing 12. In the event of a fuel or oil spill or leak within housing 12, the operator can quickly and freely position containers below or connect a hose to assembly 32 since the only housing support lies rearward of assembly 32. Additionally, small drips or puddles within the housing will flow to the bottom centerline, accumulate to form larger flows for efficient removal through assembly 32 thus producing a cleaner environment within housing 12.

The cylindrical design also provides a more efficient use of materials and space and the round top reduces snow, ice, and water build-up on top of the unit. With the preferred use of rolled sheet steel for wall 14, end caps 24 and 30, lid assembly, post 38 and standard 42 the weight and number of welds and welding time are much less than with the prior conventional remote spill containers.

It should be understood that various modifications and changes can be made to the exemplary embodiment herein disclosed without departing from the spirit and scope of the present invention. For example, housing 12 can be made in an oval or some other shape with walls sloping toward a bottom line. Apparatus parts can be made of aluminum, hard plastic, or other suitable material beside the preferred sheet steel.

I claim:

1. A remote above ground coupling and spill containment apparatus comprising:

a housing defining an enclosed chamber, said housing having a bottom wall portion, said bottom wall portion having a lowest zone, said bottom wall portion being shaped to cause liquid spills within said housing to flow toward said lowest zone, and a valve assembly communicating with said lowest zone for selectively removing spill liquid accumulated in said lowest zone, said housing further including a top wall portion and side wall portions integrally formed with said bottom wall portion to define a substantially cylindrically shaped housing having a longitudinal axis horizontally arranged, said top wall portion and side wall portions having forward portions for defining an access opening to said enclosed chamber, and wherein said housing further includes a forward wall connected to said bottom wall portion and side wall portions for closing the forward end of said chamber, and a rear wall connected to said bottom wall portion, top wall portion and side wall portions for closing the rear end of said chamber, said rear wall comprising a sealable opening at an upper region for mounting a horizontal tank delivery pipe coupling.

2. A remote spill containment apparatus according to claim 1 wherein said housing further comprises side wall portions, said top, bottom, and side wall portions being integrally formed of a single piece of sheet metal and joined by a single weld seam.

3. A remote spill containment apparatus according to claim 1 further comprising a cover member for selectively moveable between a first position for closing said access opening and a second position for enabling access through said opening, said cover member being mounted for rotation to said forward wall.

4. A remote spill containment apparatus according to claim 3 wherein said forward wall comprises a generally horizontal top edge and said cover member comprises a forward edge hinged to said top edge.

5. A remote spill containment apparatus according to claim 3 wherein said cover member comprises a lid portion for overlying the edges of said side walls that define said access opening, said lid portion lying parallel to and adjacent said front wall when said cover member is in said second position.

6. A remote spill containment apparatus according to claim 3 wherein said side wall portions comprise longitudinally extending edges defining side edges of said access opening and said side wall portions and top wall portions comprise edges in an upstanding plane that intersects the rear of said side edges, said forward wall comprising a generally horizontal top edge, said cover member comprises a lid for overlying said side edges of said access opening and having its forward edge hinged to said top edge.

7. A remote spill containment apparatus according to claim 6 wherein said cover member further comprises an upstanding closure connected to the rear portion of said lid for closing against the edges of said access opening in said upstanding plane.

8. A remote spill containment apparatus according to claim 7 wherein said closure comprises an angle piece that overlaps the edges of said access opening in said upstanding plane.

9. A remote spill containment apparatus according to claim 1 further comprising an access opening defined in the housing upper, forward portion, a cover member mounted to an upper forward part of the housing for rotation between a fully closed position and a fully open position, at least a part of said cover member being located beneath said bottom wall portion when said cover member is in said fully open position.

10. A remote spill containment apparatus according to claim 9 wherein said valve assembly is located rearward of said part of said cover member when said cover member is in said fully open position.

11. A remote spill containment apparatus according to claim 10 further comprising a supporting member connected to said bottom wall portion and located rearward of said valve assembly for supporting said housing a predetermined distance above a supporting surface, said housing being free of supporting members laterally even with and forward of said valve assembly.

12. A remote spill containment apparatus according to claim 11 wherein said housing comprises a cylindrical body having a forward end wall and a rear end wall connected to said body.

13. A remote spill containment apparatus according to claim 12 wherein said body is formed of a single piece of rolled sheet metal having no more than a single welded longitudinal seam.

14. A remote spill containment apparatus according to claim 13 wherein said forward end wall comprises a spun metal end cap having a rearward facing lip overlapping and welded to the forward edge of said body, and said rear end wall comprises a spun metal end cap having a forward facing lip overlapping and welded to the rear edge of said body.

15. A remote spill containment apparatus according to claim 14 wherein said forward end wall comprises a top edge arranged generally horizontally and across to the axis of said cylindrically shaped body, and said cover member comprises a forward edge rotatably mounted to said top edge.

16. A remote spill containment apparatus according to claim 15 wherein said body, forward end wall and rear end wall are formed from sheet steel.

17. A remote, above ground coupling and spill containment apparatus comprising:

a housing defining an enclosed chamber, said housing having a bottom wall portion, said bottom wall portion having a lowest zone, said bottom wall portion being shaped to cause liquid spills within said housing to flow toward said lowest zone, and a valve assembly communicating with said lowest zone for selectively removing spill liquid accumulated in said lowest zone, said housing further including a top wall portion and side wall portions integrally formed with said bottom wall portion to define a substantially cylindrically shaped housing having a longitudinal axis horizontally arranged, said top wall portion and side wall portions having forward portions for defining a hose access opening to said enclosed chamber, said housing further including a forward wall connected to said bottom wall portion and side wall portions for closing the forward end of said chamber, and a rear wall connected to said bottom wall portion, top wall portion and side wall portions for closing the rear end of said chamber, said rear wall comprising a sealable opening at an upper region for mounting a horizontal tank delivery pipe, a cover member selectively moveable between a first position for closing said access opening and a second position for enabling access through said opening, said cover member being mounted for rotation to said forward wall, said side wall portions comprising longitudinally extending edges defining side edges of said access opening and said side wall portions and top wall portions comprising edges in an upstanding plane that intersects the rear of said side edges, said forward wall comprising a generally horizontal top edge, said cover member comprising a lid for overlying said side edges of said access opening and having its forward edge hinged to said top edge, said cover member further comprising an upstanding closure connected to the rear portion of said lid for closing against the edges of said access opening in said upstanding plane, said closure comprising an angle piece that overlaps the edges of said access opening in said upstanding plane, and wherein said closure is positioned beneath said bottom wall portion when said cover member is in said second position.

18. A remote spill containment apparatus according to claim 17 wherein said valve assembly is positioned rearward of said closure when said cover member is in said second position.

19. A remote spill containment apparatus according to claim 18 further comprising no more than one support assembly for supporting said housing a predetermined distance above a supporting surface, said support assembly consisting of a single support standard comprising a first member connected to said bottom wall portion and a telescoping second member having a bottom base member for securing to a supporting surface, and fastening members for rigidly connecting said first and second members.

20. A remote spill containment apparatus according to claim 19 wherein said first member is located rearward of said valve assembly.

* * * * *